US007950375B2

(12) United States Patent
Wang et al.

(10) Patent No.: US 7,950,375 B2
(45) Date of Patent: May 31, 2011

(54) NOISE MINIMIZATION FOR EVAPORATIVE CANISTER VENTILATION VALVE CLEANING

(75) Inventors: Zhong Wang, Bellevue, WA (US); Tony T. Hoang, Warren, MI (US); Lan Wang, Troy, MI (US); Gary L. Rogers, Davison, MI (US); Scott A. Kegebein, Brighton, MI (US); William R. Cadman, Fenton, MI (US)

(73) Assignee: GM Global Technology Operations LLC

( * ) Notice: Subject to any disclaimer, the term of this patent is extended or adjusted under 35 U.S.C. 154(b) by 323 days.

(21) Appl. No.: 12/174,109

(22) Filed: Jul. 16, 2008

(65) Prior Publication Data

US 2009/0308359 A1 Dec. 17, 2009

Related U.S. Application Data

(60) Provisional application No. 61/060,555, filed on Jun. 11, 2008.

(51) Int. Cl.
*F02D 41/00* (2006.01)
*F02D 33/02* (2006.01)

(52) U.S. Cl. ..... 123/520

(58) Field of Classification Search ..... 123/520, 123/519

See application file for complete search history.

(56) References Cited

U.S. PATENT DOCUMENTS

| | | | | |
|---|---|---|---|---|
| 4,467,769 | A * | 8/1984 | Matsumura | 123/520 |
| 4,683,861 | A * | 8/1987 | Breitkreuz et al. | 123/520 |
| 5,850,819 | A * | 12/1998 | Kunimitsu et al. | 123/520 |
| 5,970,957 | A * | 10/1999 | Fried et al. | 123/520 |
| 6,220,230 | B1 * | 4/2001 | Kawamura et al. | 123/520 |
| 6,308,119 | B1 * | 10/2001 | Majkowski et al. | 123/520 |
| 6,412,277 | B2 * | 7/2002 | Hagen et al. | 123/520 |
| 2001/0011456 | A1 * | 8/2001 | Hagen et al. | 123/520 |

* cited by examiner

*Primary Examiner* — Stephen K Cronin
*Assistant Examiner* — Arnold Castro

(57) ABSTRACT

A control system comprising a detection module that detects at least one of a vehicle speed and an engine speed and a canister vent valve control module that selectively modulates the canister vent valve based on at least one of the vehicle speed and the engine speed. A method comprising detecting at least one of a vehicle speed and an engine speed and selectively modulating a canister vent valve based on at least one of the vehicle speed and the engine speed.

20 Claims, 4 Drawing Sheets

NOISE MINIMIZATION FOR EVAPORATIVE CANISTER VENTILATION VALVE CLEANING

CROSS-REFERENCE TO RELATED APPLICATIONS

This application claims the benefit of U.S. Provisional Application No. 61/060,555, filed on Jun. 11, 2008. The disclosure of the above application is incorporated herein by reference.

FIELD

The present disclosure relates to a control system and method for operating a canister ventilation valve in an evaporative emissions system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A vehicle typically includes a fuel tank that stores liquid fuel such as gasoline, diesel, methanol or other fuels. The liquid fuel may evaporate into fuel vapor which increases pressure within the fuel tank. Evaporation of fuel is caused by energy transferred to the fuel tank via radiation, convection, and/or conduction. An evaporative emissions control (EVAP) system is designed to store and dispose of fuel vapor to prevent release of fuel vapor into the environment. More specifically, the EVAP system returns the fuel vapor from the fuel tank to the engine for combustion therein.

The EVAP system includes an evaporative emissions canister (EEC) and a purge valve. When the fuel vapor increases within the fuel tank, the fuel vapor flows into the EEC. A purge valve controls the flow of the fuel vapor from the EEC to the intake manifold. The purge valve may be modulated between open and closed positions to adjust the flow of fuel vapor to the intake manifold. Improper operation of the purge valve may cause a variety of undesirable conditions such as idle surge, steady throttle surge, and/or undesirable emission levels.

SUMMARY

Accordingly, the present disclosure provides a control system comprising a detection module that detects at least one of a vehicle speed and an engine speed and a canister vent valve control module that selectively modulates the canister vent valve based on at least one of the vehicle speed and the engine speed. In addition, the present disclosure provides a method comprising detecting at least one of a vehicle speed and an engine speed and selectively modulating a canister vent valve based on at least one of the vehicle speed and the engine speed.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
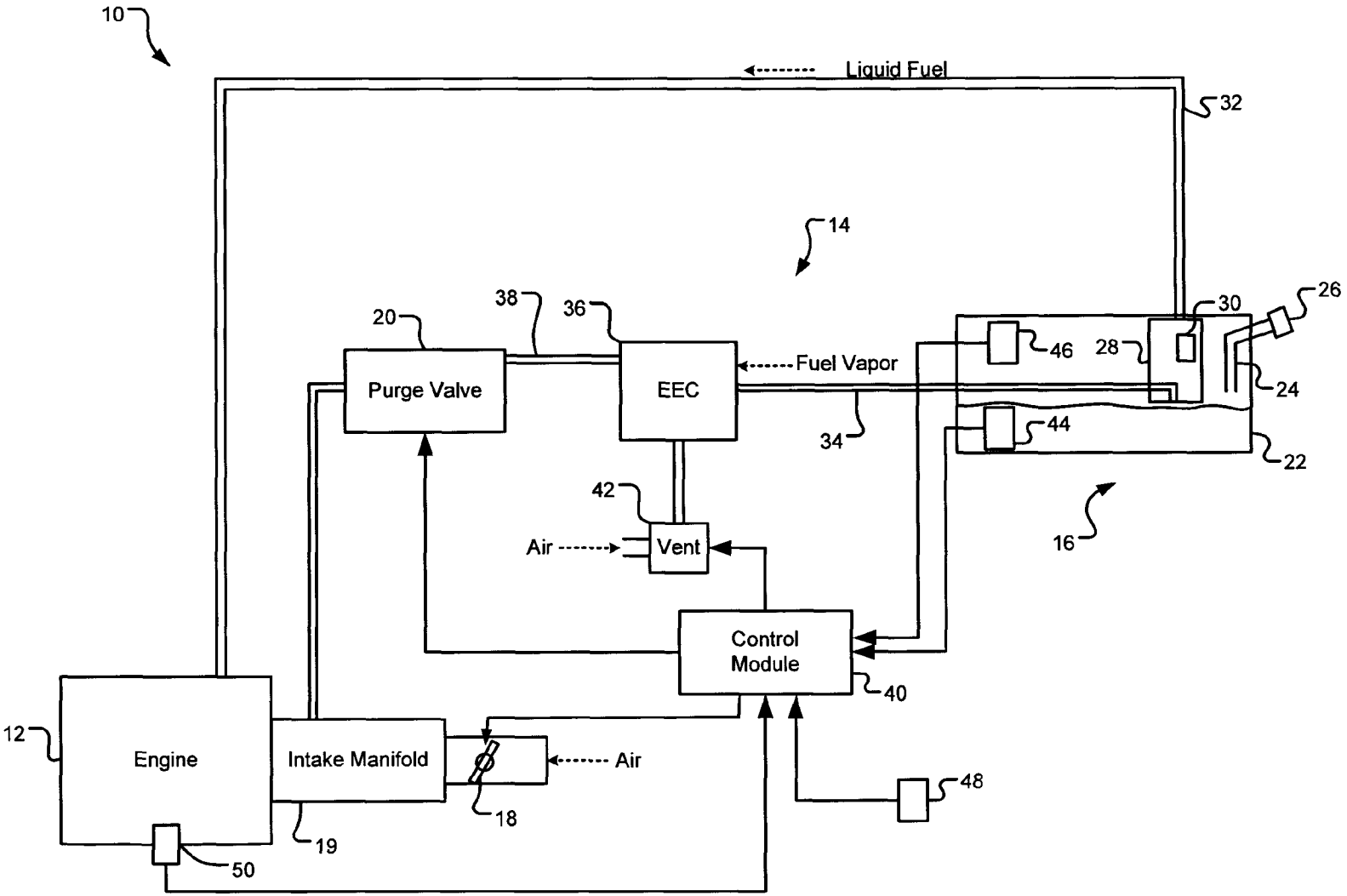
FIG. 1 is a functional block diagram of a vehicle including an evaporative emissions (EVAP) system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a vehicle 10 includes an engine 12, an evaporative emissions control (EVAP) system 14, and a fuel system 16. A throttle 18 may be adjusted to control the air flow into the intake manifold 19. The air flows from the intake manifold 19 into cylinders (not shown) where it is combined with fuel to form an air/fuel mixture.

The fuel system 16 includes a fuel tank 22 that contains both liquid and vapor fuel. A fuel inlet 24 extends from the fuel tank 22 to an outer portion of the vehicle 10 to enable fuel filling. A fuel cap 26 closes the fuel inlet 24 and may include a bleed tube (not shown). A modular reservoir assembly (MRA) 28 is located inside the fuel tank 22 and includes a fuel pump 30, a liquid fuel line 32, and a fuel vapor line 34. The fuel pump 30 pumps liquid fuel through the liquid fuel line 32 to the engine 12.

Fuel vapor flows through the fuel vapor line 34 to an evaporative emissions canister (EEC) 36. A second fuel vapor line 38 connects the EEC 36 to a purge valve 20. A control module 40 selectively modulates the purge valve 20 between open and closed positions to allow fuel vapor to flow to an intake manifold 19.

The control module 40 regulates a canister vent valve 42 to selectively enable air flow from atmosphere to the EEC 36. The control module 40 receives fuel level and pressure signals from a fuel sensor 44 and a pressure sensor 46, respectively. The pressure signal is indicative of a vapor pressure inside the fuel tank 22 and the EVAP system 14. The control module 40 selectively modulates the canister vent valve 42 between open and closed positions based on the pressure signal from the pressure sensor 46. The control module 40 may also modulate the canister vent valve 42 based on an ambient temperature and a pressure inside the intake manifold 19.

The control module 40 may perform EVAP diagnostics (EVPD) to detect vapor leaks in the EVAP system 14, including a purge valve leak test, a weak vacuum test, a canister vent restriction test, and a weak vacuum follow-up test. The purge valve leak test detects leaks through the purge valve 20 into the intake manifold 19. The weak vacuum test detects large leaks in the EVAP system 14. The canister vent restriction test detects restrictions in the canister vent valve 42. When the weak vacuum test detects a leak, the weak vacuum follow-up test is performed to determine if the leak was detected because the fuel cap 26 was not replaced after a refueling event. The control module 40 may perform the EVPD once per trip (i.e., each time the vehicle 10 is turned on). When performing the EVPD, the control module 40 monitors the vapor pressure in the EVAP system 14 via the pressure sensor 46.

When performing the purge valve leak test, the control module 40 closes the purge valve 20 and the canister vent valve 42. A high vacuum pressure indicates a leaking purge valve, while a low vacuum pressure indicates a sealed purge valve. When performing the weak vacuum test, the control module 40 opens the purge valve 20 and closes the canister vent valve 42. A high vacuum pressure indicates the EVAP system 14 is sealed, while a low vacuum pressure may indicate the EVAP system 14 has a leak when flow through the purge valve 20 is sufficient.

When performing the canister vent restriction test, the control module 40 opens the purge valve 20 and the canister vent valve 42. A high vacuum pressure indicates the canister vent valve 42 is restricted, while a low vacuum pressure may indicate the canister vent valve 42 is not restricted when flow through the purge valve 20 is sufficient. When performing the weak vacuum follow-up test, the control module 40 modulates the purge valve 20 normally and closes the canister vent valve 42. A high vacuum pressure indicates the EVAP system 14 is sealed, while a low vacuum pressure may indicate the EVAP system 14 has a leak when flow through the purge valve 20 is sufficient.

When the engine 12 is started, the control module 40 may not enable the purge valve 20 to operate until certain conditions are met. These conditions may include a waiting period to avoid excessive emissions when the engine 12 is started and a completion of emissions system diagnostics. The control module 40 may perform the purge valve leak test when the purge valve 20 is closed and not yet enabled, but EVPD that require modulation of the purge valve 20 may not be performed until the purge valve 20 is enabled.

When waiting to enable the purge valve 20, the control module 40 modulates the canister vent valve 42 between open and closed positions to remove contaminants (e.g., dirt, ice) from the canister vent valve 42 that may cause false detection of a leak. Cleaning the canister vent valve 42 via modulation may affect the vacuum pressure in the EVAP system 14 and an acoustic noise produced by the EVAP system 14. High frequency modulations and modulating the canister vent valve 42 to the closed position for short periods of time may result in significant noise levels, and a high number of modulations may result in a long duration of noise. Conversely, low frequency modulations may significantly disturb the vacuum pressure in the EVAP system 14.

The control module 40 selectively modulates the canister vent valve 42 according to the canister vent valve control system and method of the present disclosure. More specifically, the control module 40 modulates the canister vent valve 42 based on at least one of a vehicle speed received from a vehicle speed sensor 48 and an engine speed received from an engine speed sensor 50. Vehicle and engine speed thresholds are selected such that noise produced by the EVAP system 14 is less noticeable to passengers when the vehicle 10 is operating above the thresholds. When at least one of the vehicle speed and the engine speed exceed the vehicle speed threshold and the engine speed threshold, respectively, the control module 40 modulates the canister vent valve 42 between open and closed positions to remove contaminants. When neither speed exceeds the corresponding threshold, the CVV control module 200 continues to operate the canister vent valve 42 normally (e.g., normally maintaining in the closed position and occasionally modulating toward the open position based on the vapor pressure inside the EVAP system 14.)

Figure 2:
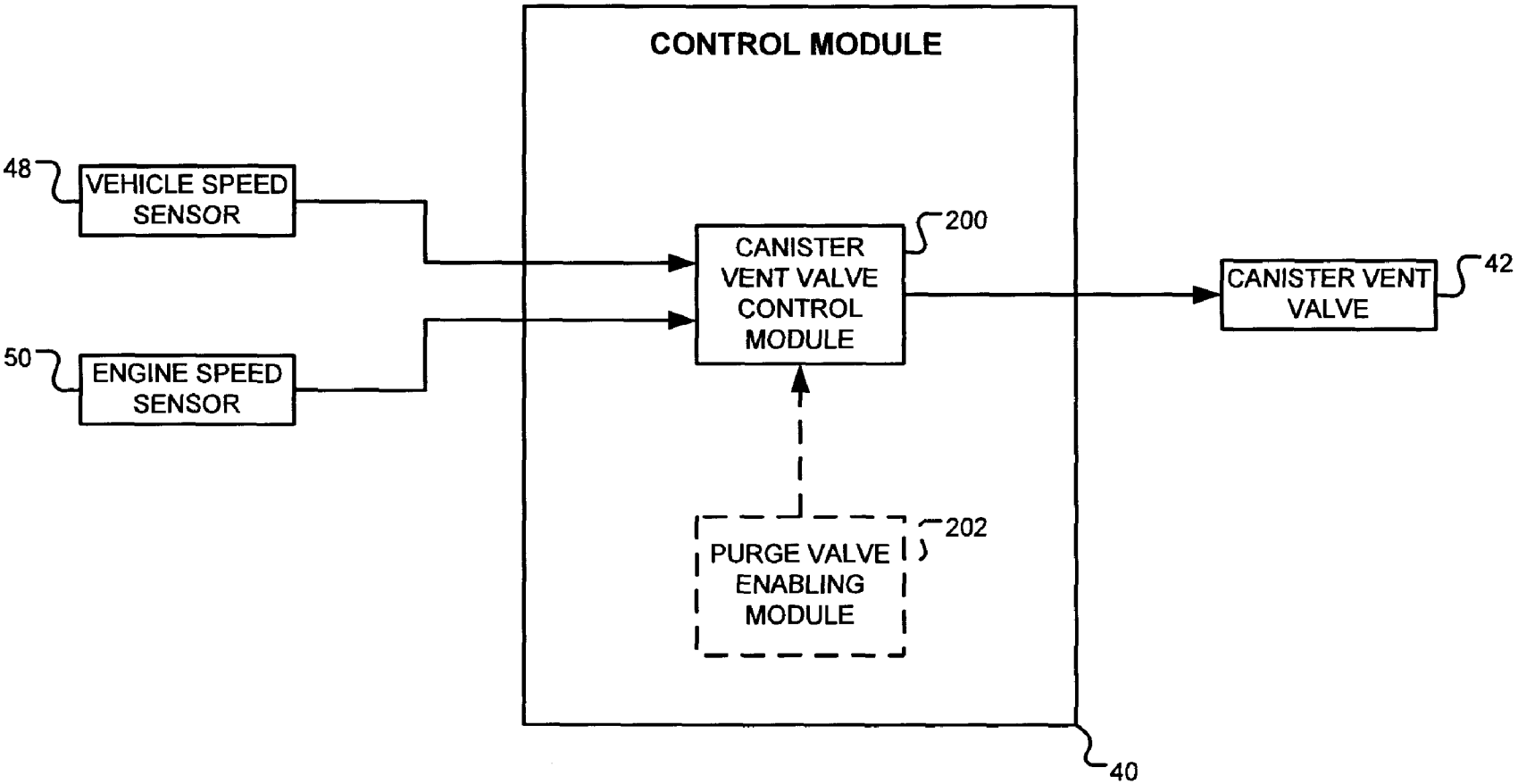
FIG. 2 is a functional block diagram illustrating exemplary modules associated with a canister vent valve control system and method according to the principles of the present disclosure.

Referring now to FIG. 2, the control module 40 includes a canister vent valve (CVV) control module 200. The CVV control module 200 receives a vehicle speed from the vehicle speed sensor 48 and an engine speed from the engine speed sensor 50. The CVV control module 200 determines whether the vehicle and engine speeds exceed predetermined thresholds. When at least one of the vehicle and engine speeds exceed the corresponding threshold, the CVV control module 200 modulates the canister vent valve 42 based on a closed time period (i.e., time period the canister vent valve 42 is modulated to the closed position), a modulation number (i.e., number of cycles the canister vent valve 42 is modulated between the open and closed positions), and a modulation frequency.

The CVV control module 200 determines the closed time period, the modulation number, and the modulation frequency based on the vehicle speed and the engine speed. The CVV control module 200 decreases the closed time period and increases the modulation number and the modulation frequency as the vehicle speed and engine speed increase. In this manner, the CVV control module 200 maximizes the contaminants removed from the canister vent valve 42 while minimizing noise noticeable to passengers and disturbance of the vacuum pressure in the EVAP system 14. The CVV control module 200 provides a control signal to the canister vent valve 42 based on the closed time period, the modulation number, and the modulation frequency.

The control module 40 may include a purge valve enabling module 202 that enables the purge valve 20 when certain conditions are met, as described in reference to FIG. 1. The purge valve enabling module 202 provides a signal to the CVV control module 200 indicating that the purge valve enabling module 202 is waiting to enable the purge valve 20. When the purge valve enabling module 202 is waiting to enable the purge valve 20, the CVV control module 200 modulates the canister vent valve 42 based on the closed time period, the modulation number, and the modulation frequency. When the purge valve enabling module 202 is not waiting to enable the purge valve 20, the CVV control module 200 continues to operate the canister vent valve 42 normally.

Figure 3:
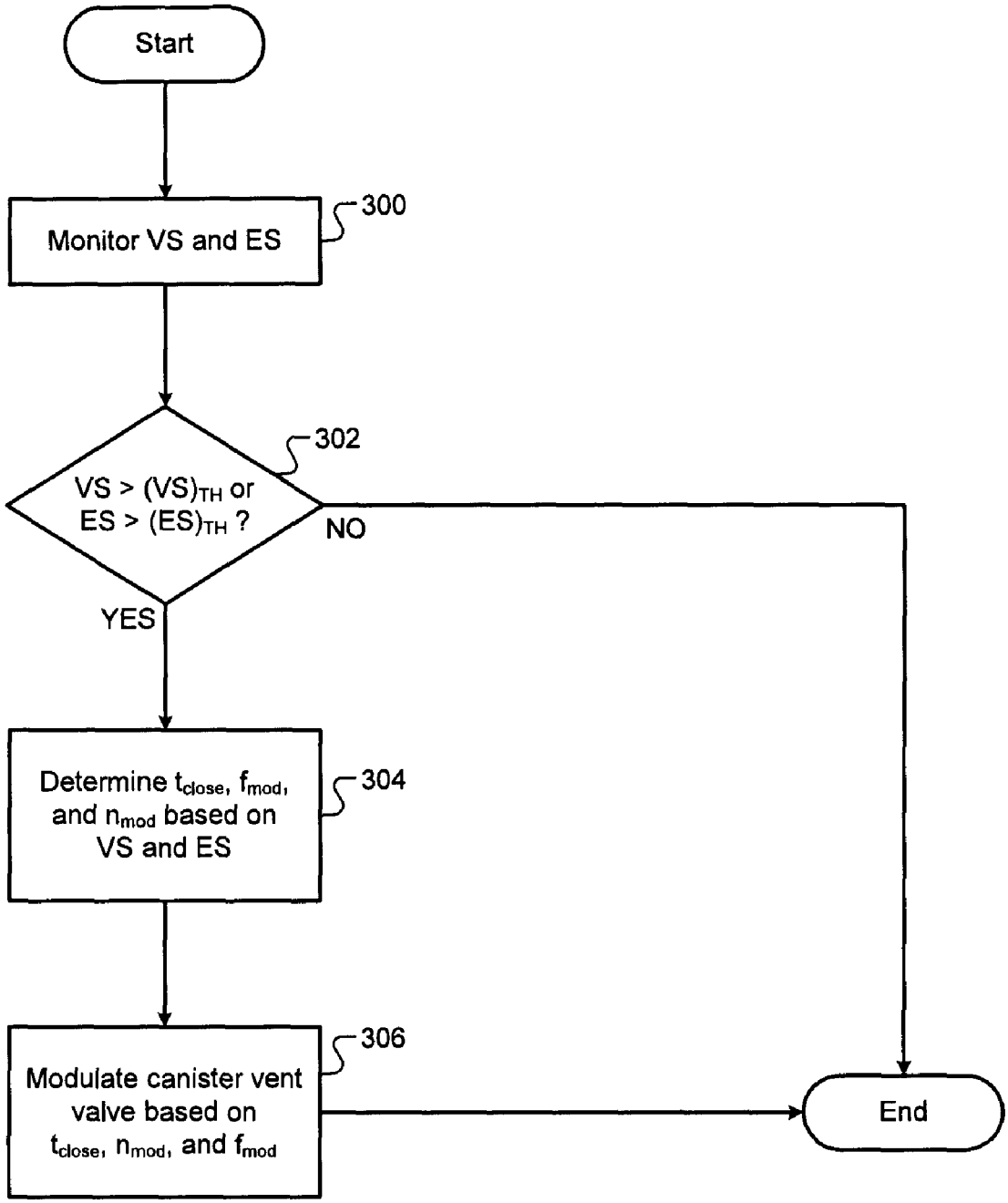
FIG. 3 is a flowchart illustrating exemplary steps executed by a canister vent valve control system and method according to the principles of the present disclosure.

Referring now to FIG. 3, a canister vent valve control method is illustrated. In step 300, control monitors a vehicle speed (VS) and an engine speed (ES). In step 302, control determines whether the vehicle speed and engine speed exceed a vehicle speed threshold $(VS)_{TH}$ and an engine speed threshold $(ES)_{TH}$, respectively. When neither speed exceeds the corresponding threshold, control continues to operate the canister vent valve 42 normally.

When at least one of the vehicle and engine speeds exceed the corresponding threshold, control determines a closed time period ($t_{closed}$), a modulation frequency ($f_{mod}$), and a modulation number ($n_{mod}$) based on the vehicle speed and the engine speed in step 304. Control decreases the closed time period and increases the modulation frequency and the modulation number as the vehicle and engine speeds increase. Alternatively, control may determine a vehicle acceleration based on the vehicle speed and determine the modulation parameters based on the vehicle acceleration and either the vehicle speed or the engine speed. Control decreases the closed time period and increases the modulation frequency and the modulation number as the vehicle acceleration increases.

In step 306, control modulates the canister vent valve 42 based on the closed time period, the modulation frequency, and the modulation number. More specifically, control modulates the canister vent valve 42 between open and closed positions a number of cycles equal to the modulation number and at a frequency equal to the modulation frequency. The canister vent valve 42 is modulated to the closed position for the closed time period.

Figure 4:
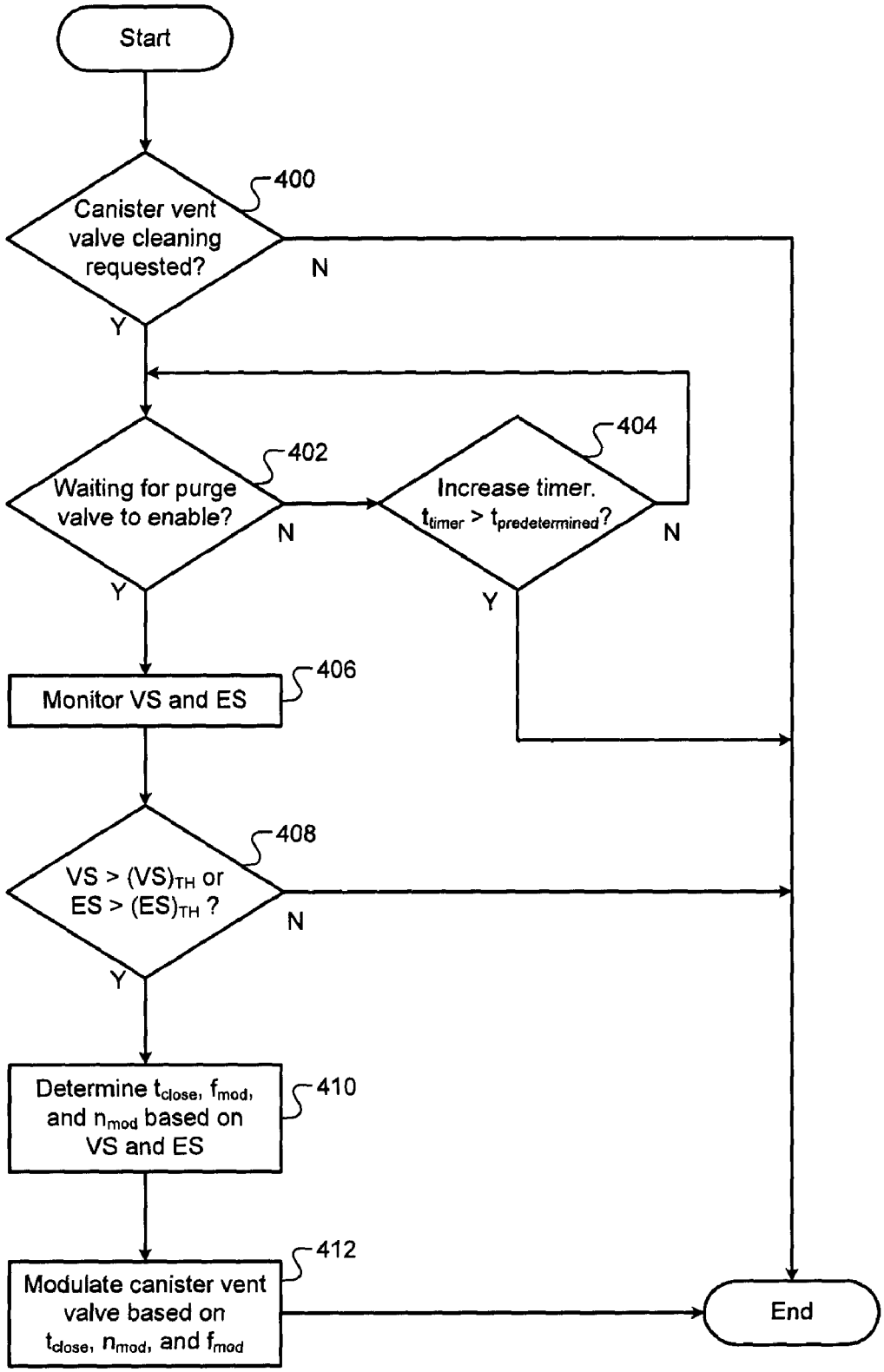
FIG. 4 is a second flowchart illustrating exemplary steps executed by a canister vent valve control system and method according to the principles of the present disclosure.

Referring now to FIG. 4, alternate exemplary steps executed by a canister vent valve control system and method of the present disclosure are illustrated. In step 400, control determines whether a canister vent valve cleaning is requested. The canister vent valve cleaning may be requested when the canister vent valve 42 has not been cleaned during the present trip and no diagnostic trouble codes (DTC) are set to indicate the EVPD may yield a false pass or fail (e.g., MAP DTC, throttle position DTC, vehicle speed DTC, intake air temperature DTC, engine coolant temperature DTC, fuel tank pressure sensor DTC, fuel level sensor DTC). When the canister vent valve cleaning is not requested, control continues to operate the canister vent valve 42 normally.

When the canister vent valve cleaning is requested, control determines whether EVPD are waiting for a purge valve to enable in step 402. When the EVPD are not waiting for a purge valve to enable, control increases a timer and determines whether the timer exceeds a predetermined time period in step 404. When the timer does not exceed the predetermined time period, control returns to step 402. When the timer exceeds the predetermined time period, control exits the canister vent valve cleaning logic to avoid a prolonged delay of the EVPD.

When the EVPD are waiting for a purge valve to enable, control monitors the vehicle speed (VS) and engine speed (ES) in step 406. In step 408, control determines whether the vehicle and engine speeds exceed a vehicle speed threshold $(VS)_{TH}$ and an engine speed threshold $(ES)_{TH}$, respectively. When neither speed exceeds the corresponding threshold, control continues to operate the canister vent valve 42 normally.

When at least one of the vehicle and engine speeds exceed the corresponding threshold, control determines a closed time period ($t_{closed}$), a modulation frequency ($f_{mod}$), and a modulation number ($n_{mod}$) based on the vehicle speed and the engine speed in step 412. Control decreases the closed time period and increases the modulation frequency and the modulation number as the vehicle and engine speeds increase. Alternatively, control may determine a vehicle acceleration based on the vehicle speed and determine the modulation parameters based on the vehicle acceleration and either the vehicle speed or the engine speed. Control decreases the closed time period and increases the modulation frequency and the modulation number as the vehicle acceleration increases.

In step 412, control modulates the canister vent valve 42 based on the closed time period, the modulation frequency, and the modulation number. More specifically, control modulates the canister vent valve 42 between open and closed positions a number of cycles equal to the modulation number and at a frequency equal to the modulation frequency. The canister vent valve 42 is modulated to the closed position for the closed time period.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system, comprising:

a detection module that detects at least one of a vehicle speed and an engine speed; and a canister vent valve control module that selectively modulates said canister vent valve from a closed position to an open position in response to a change in at least one of said vehicle speed and said engine speed, wherein said canister vent valve is in fluid communication with a canister and atmosphere.

2. The control system of claim 1 wherein said canister vent valve control module modulates said canister vent valve between said open and closed positions when said vehicle speed exceeds a vehicle speed threshold.

3. The control system of claim 1 wherein said canister vent valve control module modulates said canister vent valve between said open and closed positions when said engine speed exceeds an engine speed threshold.

4. The control system of claim 1 wherein said canister vent valve control module modulates said canister vent valve between said open and closed positions when a canister vent valve cleaning is requested.

5. The control system of claim 1 Wherein said control system determines a vehicle acceleration based on said vehicle sped.

6. The control system of claim 5 wherein said canister vent valve control module modulates said canister vent valve to said closed position for a time period that is based on at least one of said vehicle speed, said vehicle acceleration, and said engine speed.

7. The control system of claim 5 wherein said canister vent valve control module modulates said canister vent valve a number of cycles that is based on at least one of said vehicle speed, said vehicle acceleration, and said engine speed.

8. The control system of claim 5 wherein said canister vent valve control module modulates said canister vent valve at a frequency that is based on at least one of said vehicle speed, said vehicle acceleration, and said engine speed.

9. The control system of claim 1 further comprising a purge valve enabling module that enables a purge valve, wherein said canister vent valve control module selectively modulates said canister vent valve based on when said purge valve enabling module is waiting to enable said purge valve.

10. The control system of claim 9 wherein said canister vent valve control module does not modulate said canister vent valve between said open and closed positions when said purge valve enabling module does not enter a waiting period to enable said purge valve within a predetermined time period.

11. A method, comprising:

detecting at least one of a vehicle speed and an engine speed; and selectively modulating a canister vent valve from a closed position to an open position in response to a change in at leapt one of said vehicle speed and said engine speed, wherein said canister vent valve is in fluid communication with a canister and atmosphere.

12. The method of claim 11 further comprising modulating said canister vent valve between said open and closed positions when said vehicle speed exceeds a vehicle speed threshold.

13. The method of claim 11 further comprising modulating said canister vent valve between said open an closed positions when said engine speed exceeds an engine speed threshold.

14. The method of claim 11 further comprising modulating said canister vent valve between said open and closed positions when a canister vent valve cleaning is requested.

15. The method of claim 11 further comprising determining a vehicle acceleration based on said vehicle speed.

16. The method of claim 15 further comprising modulating said canister vent valve to said closed position for a time period that is based on at least one of said vehicle speed, said vehicle acceleration, and said engine speed.

17. The method of claim 15 further comprising modulating said canister vent valve a number of cycles that is based on at least one of said vehicle speed, said vehicle acceleration, and said engine speed.

18. The method of claim 15 further comprising modulating said canister vent valve at a frequency that is based on at least one of said vehicle speed, said vehicle acceleration, and said engine speed.

19. The method of claim 11 further comprising selectively modulating said canister vent valve based on when evaporative emissions diagnostics are waiting for a purge valve to enable.

20. The method of claim 19 further comprising not modulating said canister vent valve between said open and closed positions when said evaporative emissions diagnostics do not enter a waiting period to enable said purge valve within a predetermined time period.

* * * * *